United States Patent [19]

Lapish

[11] Patent Number: 4,765,108

[45] Date of Patent: Aug. 23, 1988

[54] WALL TIE

[76] Inventor: Ernest B. Lapish, 84 Stramford Park Road, Mt. Roskill, Auckland, New Zealand

[21] Appl. No.: 101,936

[22] Filed: Sep. 24, 1987

Related U.S. Application Data

[63] Continuation of Ser. No. 885,706, Jul. 15, 1986, abandoned.

[30] Foreign Application Priority Data

Jul. 17, 1985 [NZ] New Zealand ..... 212774

[51] Int. Cl.[4] ..... E04B 1/16

[52] U.S. Cl. ..... 52/379; 52/714; 248/231.91

[58] Field of Search ..... 248/231.9, 231.91; 52/379, 434, 714, 235

[56] References Cited

U.S. PATENT DOCUMENTS

| | | | |
|---|---|---|---|
| 3,213,576 | 10/1965 | Davies | 52/379 X |
| 3,377,764 | 4/1968 | Storch | 52/379 X |
| 3,715,850 | 2/1973 | Chambers | 52/235 X |
| 3,788,021 | 1/1974 | Husler | 52/379 X |
| 4,021,989 | 5/1977 | Hala | 52/235 X |
| 4,021,990 | 5/1977 | Schwalberg | 52/379 X |
| 4,373,314 | 2/1983 | Allan | 52/714 X |
| 4,473,984 | 10/1984 | Lopez | 52/379 X |
| 4,598,518 | 7/1986 | Hohmann | 52/714 X |

FOREIGN PATENT DOCUMENTS

| | | | |
|---|---|---|---|
| 2905238 | 8/1980 | Fed. Rep. of Germany | 52/235 |

*Primary Examiner*—David L. Talbott
*Attorney, Agent, or Firm*—Young & Thompson

[57] ABSTRACT

A wall tie connector for binding a masonry or glass 'veneer' wall to a support frame, having an attachment plate by which it may be fixed to such a support frame, and a twisted tie plate which is closely coupled to a rod passing through an aperture at one end of the tie plate so that the tie plate can slide from side to side along the rod. The rod is in turn connected to the attachment plate by passing through slots in a pair of flanges protruding from the attachment plate. The rod is secured in such a way that it can slide up or down within slots in the flanges of the attachment plate and is also prevented from rotating or twisting relative to the attachment plate by non-rotation structure associated therewith.

8 Claims, 2 Drawing Sheets

WALL TIE

Figure 1:
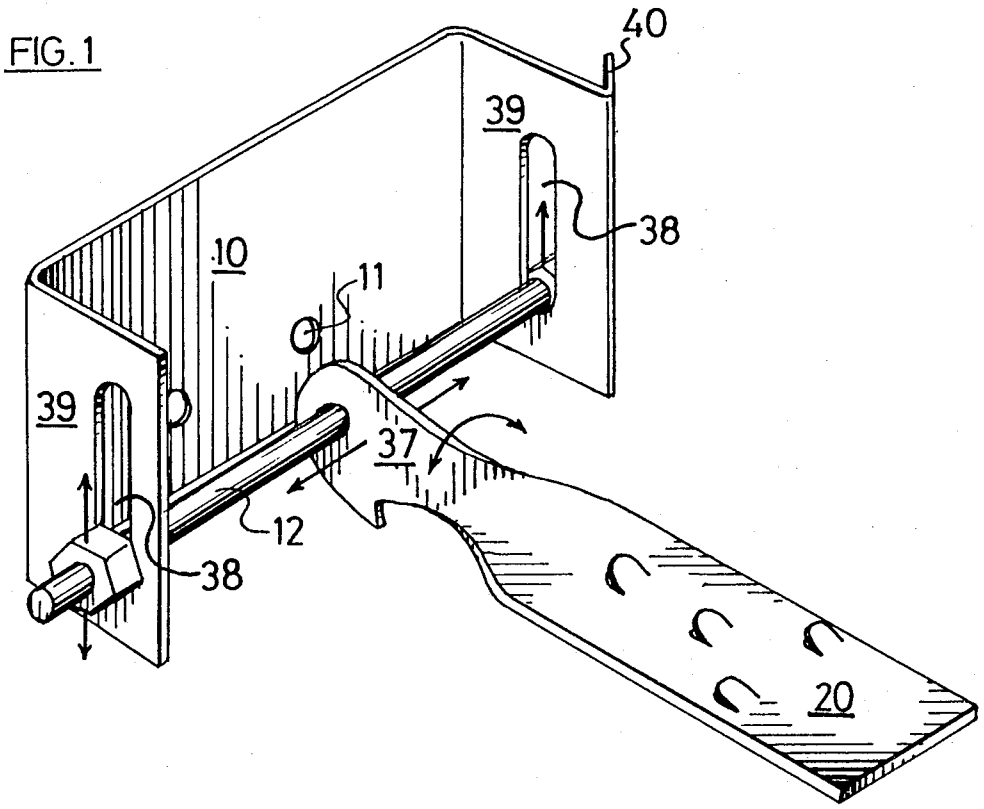

This application is a continuation of application Ser. No. 885,706, filed July 15, 1986, now abandoned.

This invention relates to a method and means for tying block or brick structures to an accompanying framework, with particular application to the provision for stresses applied by movement of the structure vertically, horizontally or pivotally with respect to the framework.

The construction of brick or block buildings, and glass-walled buildings, is often performed with the use of a wooden or metal frame as a supporting member, to which the outer wall, or "veneer", of bricks or blocks or glass is linked by ties to prevent it toppling outwards. This differs from the technique commonly and historically used in many countries where the supporting structure is and was most often also of stone or brick. As a consequence, the tying means used is also different. A wall tie commonly used in the construction of brick or block buildings is a substantially flat member, usually metal, with some form of lug, hook or loop at one end intended to be permanently fixed in the mortar of the block veneer, and a bracket or plate at the other end, set orthogonally to the major axis of the tie, by which it is nailed or otherwise fixed to the wooden support frame.

Hitherto, the wall ties of this type available, while adapted to the construction methods, often in no way take into account the stresses exerted by earthquakes and other seismic disruptions, which are a much greater menace in some parts of the world that in the lands of origin of their precursors. Because they are permanently and immoveably attached to both veneer and frame, and because during earthquakes the frame and the veneer may well be caused to move at slightly different times and/or in different directions, the wall ties form a rigid connection which is under considerable strain on these occasions, and substantial damage can result.

The same or similar strains also apply in wooden framed brick or block buildings in the time just after construction, when the wooden frame has a tendency to shrink and/or warp slightly as it loses moisture to the atmosphere, and the brick or block veneer expands as moisture from the atmosphere is absorbed.

It is an object of this invention to provide a wall tying means which allows for some movement of a veneer relative to its support frame, without compromising significantly the degree to which the veneer is supported by the frame, or to at least provide the building industry with a useful choice.

In one aspect the invention provides apparatus for connecting a masonry structure formed from brick, stone, concrete or similar blocks, or a glass or other panel structure, to a supportive framework or member, said apparatus being substantially inextensible along its major axis, but being provided with means which enable the connection of said apparatus to said masonry structure at one end to move horizontally and/or vertically and/or pivotally with respect to the connection of said apparatus to said supportive framework or member at the other end while in use.

Preferably said movement enabled by said means is limited.

Preferably the apparatus comprises two or more discrete members, moveably linked to one another, wherein the connection to the structure at one end is formed by one or more said members, and the connection to the supportive framework or member at the other end is formed by a different one or more said members.

Alternatively or in addition the apparatus may include one or more flexible and/or resilient portions forming a link between the connection of said apparatus to the masonry structure and the connection of said apparatus to the supportive framework or member.

In another aspect the invention provides a method and means by which the apparatus can be easily and substantially permanently attached to either or both of a structure formed with brick, stone, concrete or similar block, or a glass or other panel structure, and a supportive framework or member, of wood or metal.

Preferably said means inlcudes one or more apertures in or near one end, suitable for use with nails, screws, bolts, or other similar elongate securing members.

Preferably said apertures are set in a plate or flange on the apparatus which in use lies substantially in the same plane as the surface to which it is attached.

Preferably the apparatus includes a plate flange or handle extending in a plane essentially orthogonal to the plane of the attachment plate mentioned above, in a position such that it can be used as a handle for holding and placing the apparatus and/or the attachment plate in an appropriate position and orientation prior to attachment to a surface.

Preferably at a position substantially at the opposite end of the major axis of the apparatus with respect to the attachment plate the apparatus includes a plurality of lugs, nodules, knobs, studs, flanges, barbs or similar protrusions, such that when set in cement it can be substantially permanently fixed.

These and other aspects of this invention, which should be considered in all its novel aspects, will become apparent from the following description which is given by way of example only, with reference to the accompanying drawings, in which:

FIG. 1: shows a perspective view of a first embodiment of the apparatus.

Figure 2:
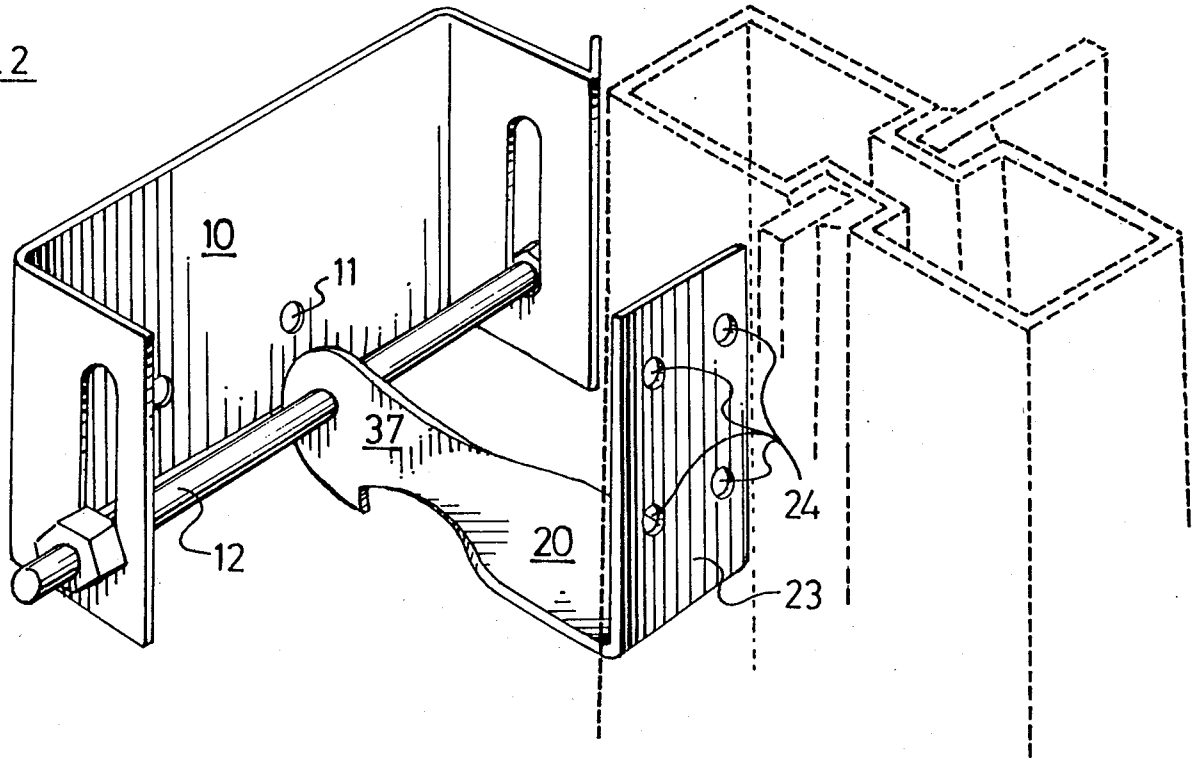

FIG. 2: shows a perspective view of a second embodiment of the apparatus.

In its preferred embodiment the invention consists of an attachment plate for attachment to the supportive framework, one or more retaining plates or pins for afixment in the cement of a brick or block wall, and one or more limber portions to enable movement of one end relative to the other. Each of these basic parts may take any one of a variety of forms.

The attachment plate will generally lie on a plane orthogonal to the major axis of the tie. It will have a substantially flat "back" surface 10 which in use is juxtaposed with a surface of the supportive frame or member to which it is being attached. This surface may, if desired, be adorned with pins, ribs, teeth or similar for better gripping of the supportive frame or member, but this is by no means essential. The plate is pierced by one or more holes 11—round, elongated or of any of a number of other shapes—such that it can be fixed to an adjoining supporting member by means of nails, screws, bolts etc. The plate may also be braced by a variety of ribs, blocks or buttresses or may be unsupported, and may include a fin, flange or handle of some variety by which it can be held while being attached to the supporting member.

The apparatus of FIG. 1 uses a metal retaining plate 20, which is twisted through 90° so as to provide a vertical connecting portion 37 while the plate 20 lies in a horizontal plane.

A rod passes through an aperature in the connecting portion 37, along which the said portion of the plate 20 can slide.

This rod also passes through a vertically extending slot 38 in a protruding flange 39 at either end of the attachment plate 10. The rod is loosely held in place by a nut at either end, and is able to move up and down the slots 38, together with the retaining plate 20. Horizontal movement is therefore made possible by the retaining plate sliding along the rod, vertical movement is possible with the rod sliding in the slots in the attachment plate, and rotational movement is possible by twisting of the retaining plate which, being of metal, is ductile. A pressed steel plate is sufficiently ductile for this purpose, although other ductile materials will be apparent to those skilled in the art.

The attachment plate 20 is preferably connected to a support frame by more than one bolt, nail or screw. It may include on one or both flanges 39, a recurving lip 40 which engages in use with the nut on the end of the rod, to prevent it from twisting.

The apparatus of FIG. 2, is similar to that of FIG. 1, with a further bend in the retaining plate 20, such that the end of the plate 20 extends in a vertical plate, transverse to the major axis, as shown. In this way it forms an attachment plate 23 standing parallel to the plane of the attachment plate 10, which may be used for attachment to a panel veneer, such as a glass wall, as opposed to a masonry veneer. Holes 24 for securing means such as nails, screws, bolts or similar fasteners may be provided, by which the attachment plate 23 may be fixed either to a frame structure between panels, as shown, or to the panels themselves. The holes 24 could be in the form of slots to give additional freedom of movement if required, and it will readily be appreciated that apparatus such as that shown in FIG. 2, having two transverse vertical attachment plates rather than one attachment plate and one retaining plate as described above, might be turned around such that the plate 10 connects to a veneer, and plate 23 to a support structure.

The most useful embodiments of the invention will preferably include more than one limber portion, as illustrated in the Figures. By combinations of the movements made available by each mechanism, a movement of either end of the device is possible horizontally, vertically, pivotally or in any combination of the above.

The degree of movement allowed in normal use with apparatus of the present invention may be varied considerably by changes to the relative dimensions of various parts, or the use of different materials. By way of example, apparatus as shown in FIG. 1 may be constructed according to the present invention and in such a way that approximately 20 mm of movement sideways of one plate relative to the other is possible in either direction, approximately 10 mm of movement up or down is possible, and rotation through an arc of approximately 30° is possible. Longitudinal extension or compression of the apparatus may occur to the order of approximately 5 mm under normal stresses, which such apparatus. These may be considered as suitable degrees of freedom in a number of construction applications, and it will readily be appreciated that alternations may easily be made within the scope of the invention to suit the apparatus to other applications.

It will also be appreciated that many other changes and alterations could be made to the foregoing without departing from the spirit or scope of this invention which may be exemplified by the following claims.

I claim:

1. A wall tie connector for binding a first wall structure to a second wall structure, comprising:

an attachment plate having means for attachment to a first wall structure said attachment plate having a pair of flanges protruding from the plane of the attachment plate, each flange having an aperture therein, a rod or bolt carried by said attachment plate and passing through said apertures in said flanges, a retaining member having means adjacent a first end thereof for attachment to a second wall structure, said retaining member having an aperture adjacent a second end thereof through which the rod or bolt passes to connect said retaining member to the attachment plate, said retaining member aperture being only slightly larger than the rod or bolt so that the retaining member is closely coupled to said rod or bolt in the axial direction of the retaining member but slides along and rotates about the rod or bolt, and means for allowing bodily movement of the retaining member in a direction parallel to said attachment plate and to said flanges.

2. A wall tie connector as claimed in claim 1, wherein non-rotation means is provided to prevent said rod or bolt rotating about its longitudinal axis.

3. A wall tie connector as claimed in claim 2, wherein said non-rotation means includes a recurving lip on one of said flanges of the attachment plate, said lip engaging in use a shaped head of the rod or bolt.

4. A wall tie connector as claimed in claim 3, wherein said mid-portion and said first end of said retaining member are substantially flat for insertion between courses of masonry forming said veneer wall.

5. A wall tie connector as claimed in claim 3, wherein said rod or bolt is round.

6. A wall tie connector as claimed in claim 5, wherein said first end of said retaining member is bent through substantially 90° relative to said mid-portion thereof to enable said first end to provide an attachment surface for a glass or other panel structure forming said veneer wall.

7. A wall tie connector as claimed in claim 1, wherein the means for allowing bodily movement consists of said apertures in the flanges being in the shape of elongated slots, each slot having closed ends, each said slot being substantially parallel to the plane of the attachment plate, so that the rod or bolt is capable of sliding movement along the length of said elongated slots.

8. A wall tie connector as claimed in claim 7, wherein said retaining member comprises a plate having the second end disposing substantially 90° relative to a mid-portion of the plate.

* * * * *